US008058811B2

(12) United States Patent
Green

(10) Patent No.: US 8,058,811 B2
(45) Date of Patent: Nov. 15, 2011

(54) HID LAMP BALLAST CIRCUIT

(75) Inventor: Peter Green, Redondo Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 285 days.

(21) Appl. No.: 12/056,088

(22) Filed: Mar. 26, 2008

(65) Prior Publication Data

US 2008/0238334 A1 Oct. 2, 2008

Related U.S. Application Data

(60) Provisional application No. 60/908,025, filed on Mar. 26, 2007, provisional application No. 60/908,006, filed on Mar. 26, 2007.

(51) Int. Cl.
*H05B 37/02* (2006.01)

(52) U.S. Cl. ..... 315/224; 315/291; 315/DIG. 7

(58) Field of Classification Search ..... 315/291, 315/209 R, 224, 225, DIG. 5, DIG. 7, 219
See application file for complete search history.

(56) References Cited

U.S. PATENT DOCUMENTS 6,121,731 A * 9/2000 Kanazawa et al. ..... 315/194
2005/0046359 A1 * 3/2005 Alexandrov ..... 315/248

* cited by examiner

*Primary Examiner* — David Hung Vu
(74) *Attorney, Agent, or Firm* — Farjami & Farjami LLP

(57) ABSTRACT

A ballast circuit operable to drive a high intensity discharge lamp in accordance with an embodiment of the present applications includes an energy conversion circuit operable to convert an input voltage into a bus voltage and to provide the bus voltage to a DC bus, a first half bridge connected across the DC bus and operable to control an output voltage supplied to the lamp, a control circuit operable to control the half bridge such that a desired output voltage is provided to the lamp, a series inductor connected in series between the half bridge and the lamp; and a parallel capacitor resistor connected across the lamp. The control circuit operates the half bridge at a high frequency for a set period of time such that a high voltage is built up across the parallel resistor, and then reduces the frequency of the half bridge until it approaches a resonance frequency which ignites the lamp.

20 Claims, 9 Drawing Sheets

HID LAMP BALLAST CIRCUIT

CROSS-REFERENCE TO RELATED APPLICATIONS

The present application claims benefit of and priority to U.S. Provisional Patent Application Ser. No. 60/908,006 filed Mar. 26, 2007 entitled HALF BRIDGE HID BALLAST SYSTEM AND CONTROL IC BASED ON FLYBACK TOPOLOGY and U.S. Provisional Patent Application Ser. No. 60/908,025 filed Mar. 26, 2007 entitled HID BALLAST SYSTEM AND CONTROL IC BASED ON COMBINED LOW AND HIGH FREQUENCY HALF BRIDGE SWITCHING, the entire contents of each of which is hereby incorporated by reference herein.

BACKGROUND OF THE INVENTION

High intensity discharge (HID) lamps are highly desirable for commercial markets due to their superior light efficiency in terms of lumens produced per watt and the variety of power ranges in which they are available. As HID lamp technology has developed, manufacturers and ballast designers have come to focus on reliability and efficiency in providing a robust and simple HID lighting system.

U.S. Pat. No. 7,078,870, which is assigned to the assignee of the present application, International Rectifier Corporation, discloses an example of a ballast circuit for use in driving an HID lamp. The entire contents of U.S. Pat. No. 7,078,870 are hereby incorporated by reference herein. The ballast system disclosed in this reference, however, fails to take into account the behavior of the HID lamp immediately after ignition and in the warm up phase. When high voltage is applied across an HID lamp, the lamp produces an arc which will initially draw a very large current, resulting in lamp voltage dropping as low as 20V or less. Immediately after ignition, most of the energy stored in the series capacitors C1, C2 to which the lamp is returned is discharged into the lamp. If the amount of energy is too small, or too great, the lamp will extinguish immediately after ignition such that the result is merely merely a flash.

Using the system described in U.S. Pat. No. 7,078,870, the capacitors C1, C2 would have to be very small in order to prevent too much energy from being discharged into the lamp. However, the lamp current immediately after ignition must be maintained at a sufficiently high level to keep the lamp lit. This would be impossible using such small capacitors.

Thus, it would be desirable to provide ballast circuit system that avoids these problems.

SUMMARY OF THE INVENTION

It is an object of the present invention to provide a ballast circuit for use with a high intensity discharge lamp that avoids the problems identified above.

A ballast circuit operable to drive a high intensity discharge lamp in accordance with an embodiment of the present applications includes an energy conversion circuit operable to convert an input voltage into a bus voltage and to provide the bus voltage to a DC bus, a first half bridge connected across the DC bus and operable to control an output voltage supplied to the lamp, a control circuit operable to control the half bridge such that a desired output voltage is provided to the lamp, a series inductor connected in series between the half bridge and the lamp; and a parallel capacitor resistor connected across the lamp. The control circuit operates the half bridge at a high frequency for a set period of time such that a high voltage is built up across the parallel resistor, and then reduces the frequency of the half bridge until it approaches a resonance frequency which ignites the lamp.

A ballast circuit operable to drive a high intensity lamp in accordance with an embodiment of the present applications includes an energy conversion circuit operable to convert an input voltage into a bus voltage and to provide the bus voltage to a DC bus, a half bridge connected across the DC bus and operable to control an output voltage supplied to the lamp, a control circuit operable to control the half bridge such that a desired output voltage is provided to the lamp, a series inductor connected between the half bridge and the lamp and a parallel capacitor resistor connected across the lamp. The control circuit controls the half bridge to provide a combination signal to drive the lamp, the combination signal including a high frequency component and a low frequency component.

Other features and advantages of the present invention will become apparent from the following description of the invention which refers to the accompanying drawings.

BRIEF DESCRIPTION OF THE DRAWING(S)

DETAILED DESCRIPTION OF PREFERRED EMBODIMENTS OF THE INVENTION

Figure 1:
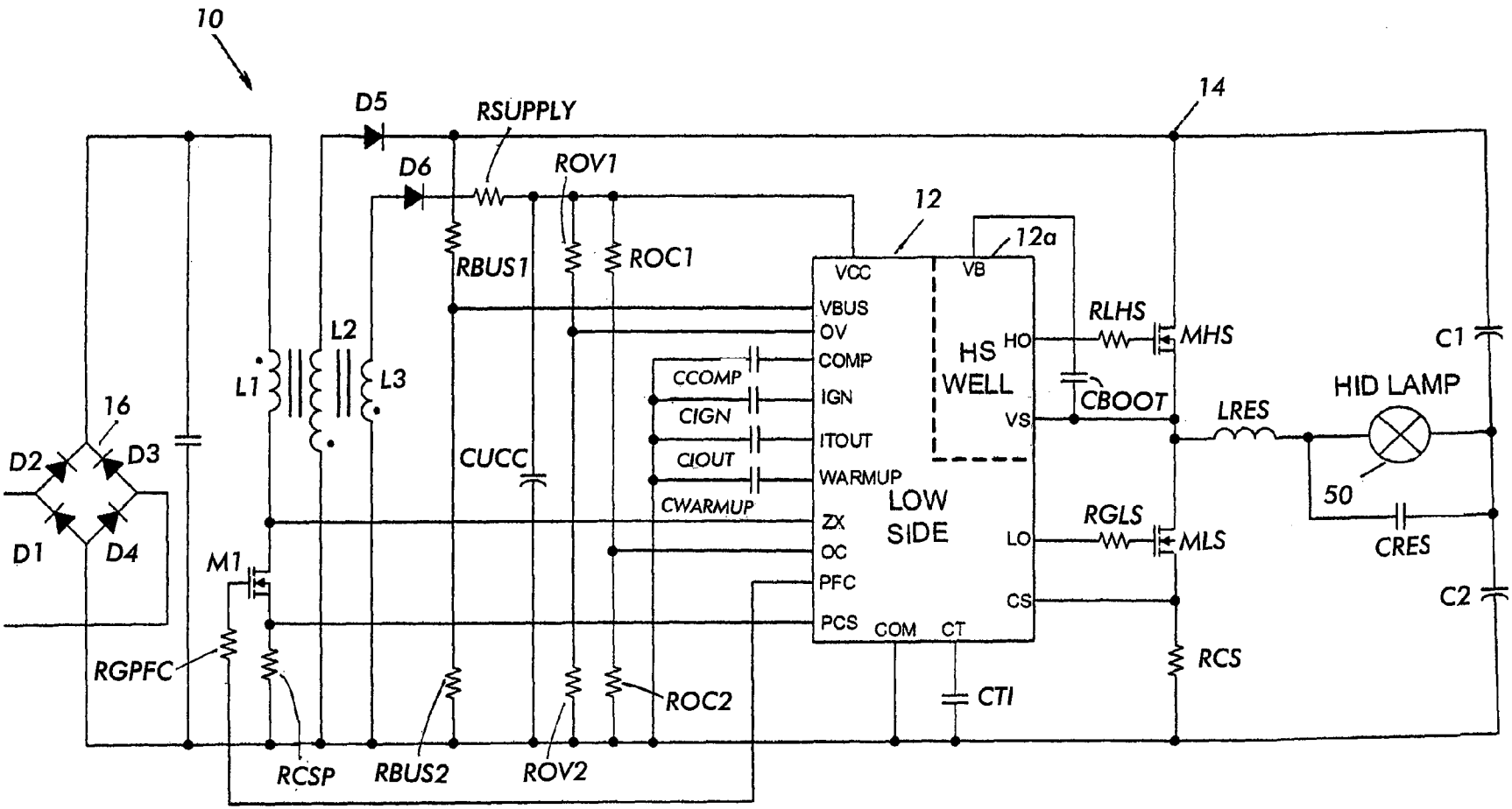
FIG. 1 illustrates a ballast circuit in accordance with an embodiment of the present application.

A ballast circuit 10 for use in driving an HID in accordance with the present application is described with reference to FIG. 1, for example. The ballast circuit 10 of FIG. 1 represents an improvement over that described above.

In the ballast circuit 10 of the present application a series inductor LRES is provided in series with the lamp 50 and capacitor CRES is provided across the lamp. The half bridge 14 operates at high frequency during ignition (S34 in FIG. 3) and warm up (S36 in FIG. 3) in order to overcome the problems described above, allowing the DC bus voltage to be much greater than the lamp voltage and the lamp current to be controlled during warmup based on ballasting provided by the series inductor LRES. Only in steady state operation will the half bridge 14 oscillate in low frequency at which point the inductor LRES and capacitor CRES will have negligible effects. The lamp voltage at this point may be presumed to be equal to half the DC bus voltage. Thus, the capacitors C1, C2 may be a practical size and the lamp current during warm up can be controlled by frequency modulation of the half bridge switching voltage.

The voltage required to ignite a cold medal halide lamp, for example, is typically 3-4 kV. The system 10 of the present application eliminates the need for a separate ignition circuit as it can employ the technique of scanning the frequency from a level above resonance, down towards the un-damped resonance frequency to provide the high voltage required to start the lamp 50. The values of the inductor LRES and the capacitor CRES will determine the resonance frequency at which ignition occurs.

The topology of the ballast circuit 10 and the control integrated circuit 12 used to control it, is intended for use in HID designs where lamp power is relatively low, for example, 20 W, 35 W and 70 W and cost, as well as physical size are key considerations. Furthermore, the ballast circuit 10 of the present application is suitable for off line applications, where ballasts may be required to operate from 120 VAC, 220VAC or 277VAC line voltages. However, the ballast system 10 of the present application is generally not suitable for lamps with hot re-strike capability since resonance starting is not practical for producing the 20 kV starting voltage typically used in this environment.

The ballast circuit 10 preferably uses a control circuit 12 similar to the assignee International Rectifier Corporation's ballast control integrated circuit IRS2168D, which is well known. The data sheet for this circuit is publicly available as International Rectifier Corporation Data Sheet No. PD60310. The IRS2168D is also described in U.S. Pat. No. 7,298,099, the entire contents of which are hereby incorporated by reference herein. In addition, FIGS. 8-10 of the present application illustrate further details of the IRS2168D.

The control circuit 12 preferably includes a power factor correction power control stage similar to that used in the IRS2168D where the switching MOSFET M1 is driven by a signal of pin PFC from a low voltage gate drive system in control circuit 12 to provide power factor correction.

The control circuit 12 preferably also includes zero crossing detection provided from the drain of the flyback switching MOSFET M1 via pin ZX of the control circuit 12. This allows the control circuit 12 to determine when all of the energy from the coil L1 has been transferred from the load (the lamp) so that the circuit operates in critical conduction mode. That is, the voltage at the drain of the MOSFET M1 will indicate when a zero crossing occurs in the inductor coil L1 of flyback transformer T1. As can be seen in FIG. 1, in a preferred embodiment, input voltage is provided from AC main lines and rectified by the full bridge rectifier 16. The rectified voltage is provided to the inductor L1 which is the primary coil of the transformer T1 to provide the DC bus voltage and supply voltage. The DC bus voltage is preferably regulated via the half bridge 14 to provide constant power in the lamp 50 after the warm up phase (S36 in FIG. 3) when the lamp 50 has reached a steady operating state. This power management is accomplished by feeding back the lamp current (via pin IL) and the DC bus voltage to a multiplier in the control circuit 12 to provide an indication of "true" lamp power as opposed to an estimate based only the lamp voltage.

The flyback switching MOSFET M1 preferably also includes a current sensing resistor RCSP connected from the source of the MOSFET M1 to the common return COM to provide protection against short circuit or saturation of the flyback inductor L1. That is the MOSFET M1 allows for cycle by cycle current limiting in a manner similar to that provided in the IRS2168D as well.

A single floating high side well 12*a* is preferably provided in the control circuit 12 to drive the gate of the high side switch MHS of the half bridge 14 via output pin HO. The lamp current is preferably sensed by current sense resistor RCS while the low side switch MLS is ON. The lamp voltage will be presumed to be equal to half the bus voltage in steady state, low frequency operation. The RCS resistor will also provide feedback to regulate lamp current during warm up where the half bridge 14 switches at a high frequency with a duty cycle close to 50% but including a fixed dead time to allow commutation to take place and soft switching.

Figure 2:
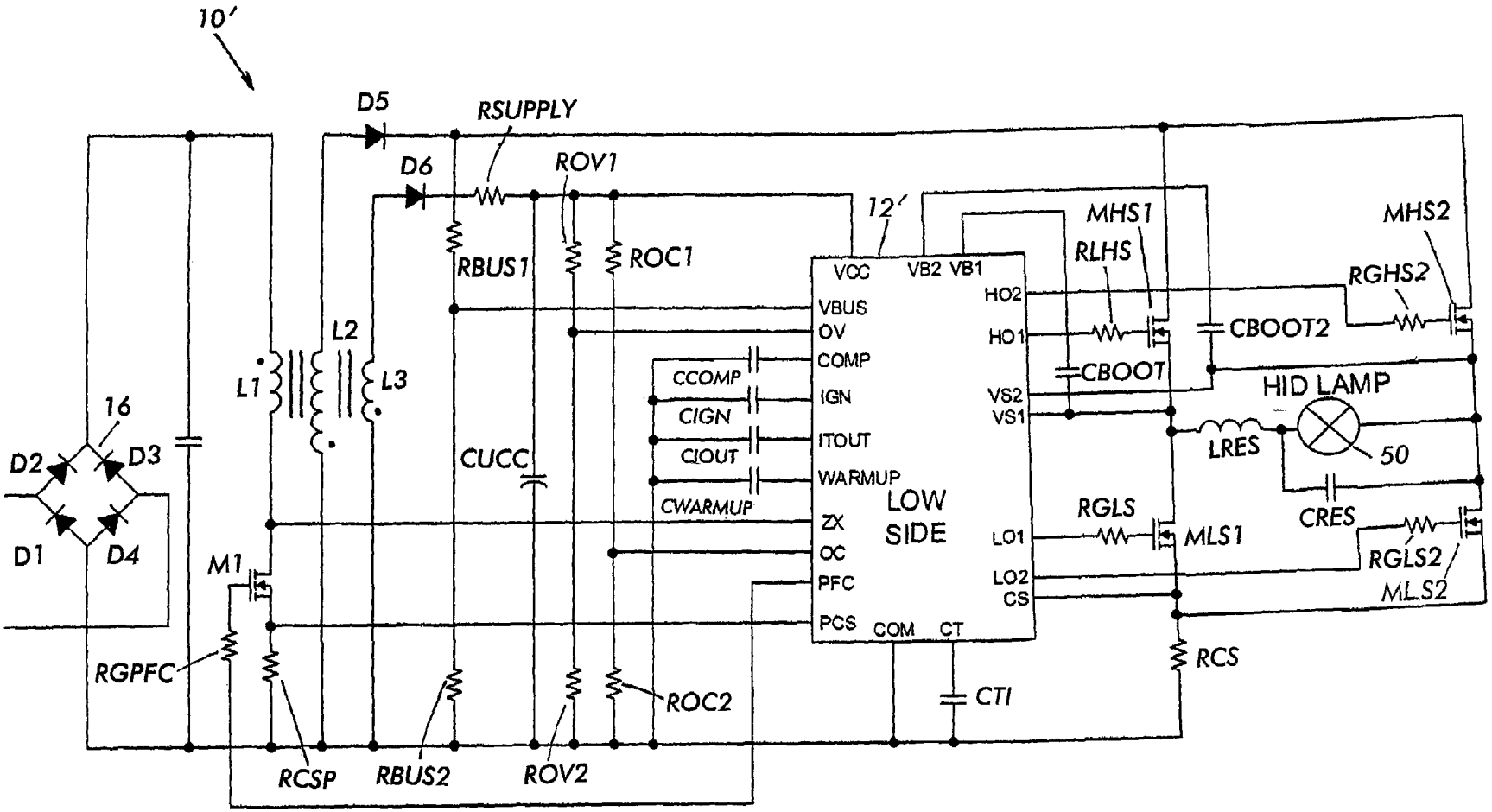
FIG. 2 illustrates a ballast circuit in accordance with another embodiment of the present application.

A full bridge implementation of a ballast circuit in accordance with the present application is illustrated in FIG. 2. The ballast circuit 101 of FIG. 2 is useful for driving high powered lamps. This system provides certain advantages over conventional systems which typically include a power factor correction stage followed by a power regulating Buck regulator and finally by a low frequency full bridge stage. The ballast circuit 10 allows the full DC bus voltage to be switched across the lamp 50 and does not rely on the DC bus capacitors (C1, C2 of FIG. 1, for example) to conduct the lamp current, which makes it possible for the ballast to supply greater lamp current and power. The control circuit $\mathbf{12}^1$ is similar to the control circuit 12 discussed above, but includes additional high side and low side drivers to drive the additional high side (MHS2) and low side (MLS2) switches of the other half of the bridge.

Figure 3:
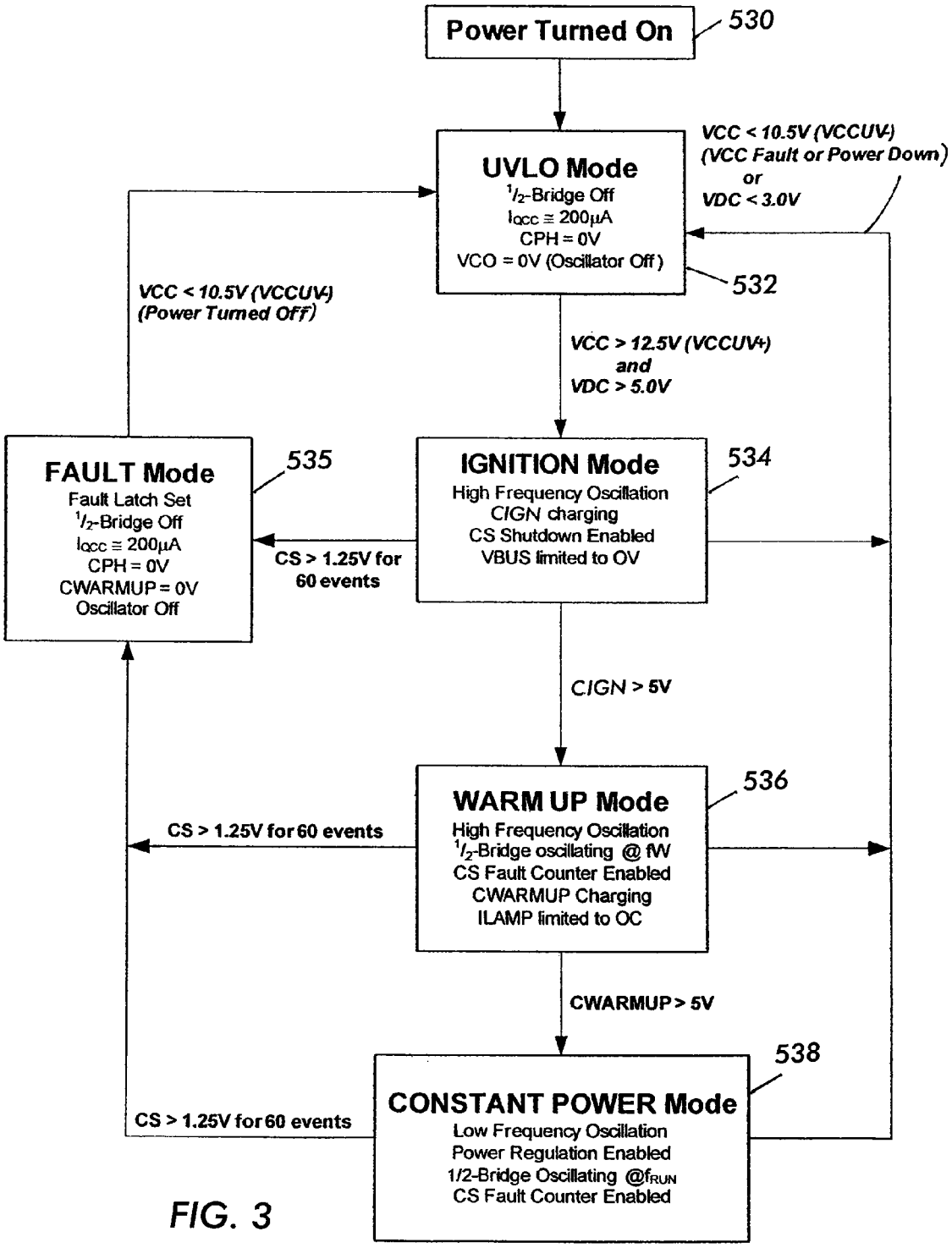
FIG. 3 is a state diagram illustrating the various modes in which the ballast circuits of FIGS. 1 and 2 operate.

FIG. 3 is a state diagram illustrating how the control circuit (s) 12, 12' control the progression of the ballast circuit 10 through ignition (S34 of FIG. 3) and warm up (S36 of FIG. 3) and finally into the constant running phase. In addition, the state diagram of FIG. 3 illustrates the over voltage limiting features of the ballast circuit 10. In a preferred embodiment, over voltage limiting is provided during warm up and during the constant power phase to prevent the lamp current from exceeding a programmed limit. This also provides protection against short circuit at the output as well. Timers are preferably provided in the control circuit 12 such that if an over current or over voltage condition continues for longer than a predetermined time, the control circuit will shut down to prevent damage to the system. The control circuit 12 preferably does not attempt an auto-restart such that input power must be re-cycled in order to restart the ballast.

As illustrated in FIG. 3, once the power is turned on S30, the ballast system enters under voltage lock out (LWLO) mode S32. The half bridge 14 is OFF as well as the oscillator. When the supply voltage at pin VCC exceeds the positive under voltage limit VCCUV+ (12.5 volts in FIG. 3) and when the enable signal VDC reaches 5V, ignition mode S34 is entered. High frequency oscillation of the half bridge 14 begins and the capacitor CIGN starts charging, preferably via an internal switch (not shown) in the control circuit 12. Current sensing also begins using feedback information provided via pin CS. If the voltage at this pin rises above 1.25 volts for more than a predetermined period of time, fault mode S37 is entered and the half bridge 14 is turned off along with the oscillator. When the voltage across capacitor CIGN provide to the IGN pin exceeds a set amount (5 volts in FIG. 3) warm up mode S36 begins. High frequency oscillation continues as the capacitor CWARMUP charges and the lamp current is limited as mentioned above. Once the voltage across the capacitor CWARMUP provided to pin WARMUP of control circuit 12 reaches a predetermined value (5V in FIG. 3) constant power, or run mode S38 is entered. Low frequency oscillation is used and the bridge 14 runs at its desired operating frequency. Current sensing continues. The ballast circuit 10 stays in this mode unless a fault occurs, i.e.: the voltage at pin CS exceeds 1.25 volts for a set time period or the supply voltage VCC drops down below a lower under voltage threshold voltage VCCUV− (10.5 volts in FIG. 3) or the enable signal VDC goes low (less than 3V) for a required time.

Figure 4:
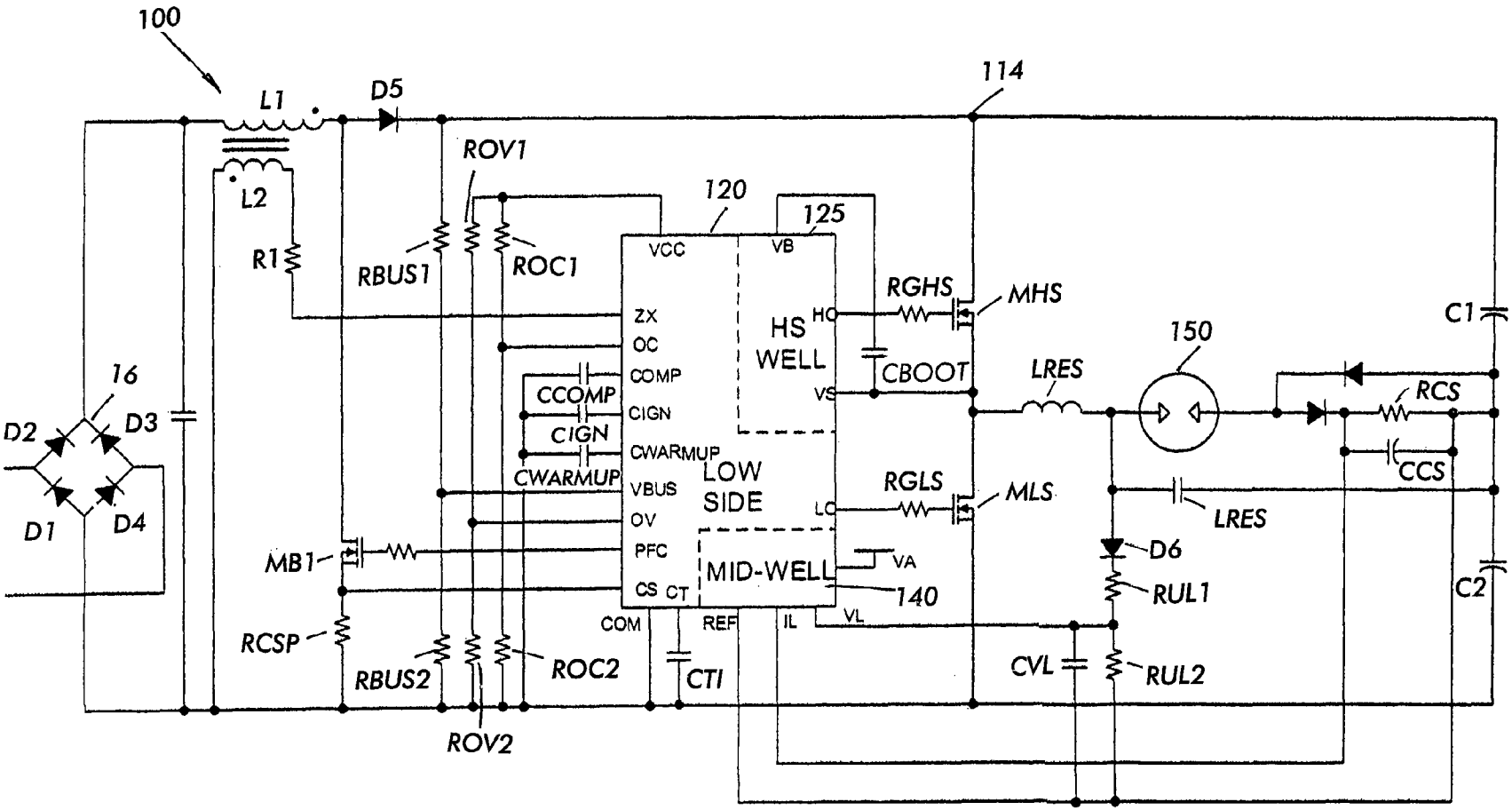
FIG. 4 illustrates a ballast circuit in accordance with another embodiment of the present application.

In an alternative embodiment of the present application illustrated in FIG. 4, a ballast circuit 100 utilizing a boost converter may be used. The boost converter is preferably controlled such that it operates slowly relative to the AC line frequency to ensure that PWM on time remains substantially constant over each line half cycle so that power factor correcting is provided. In addition, on time modulation may be used to minimize the harmonic content of the AC line current in a manner similar to that employed by the above mentioned IRS2168D ballast control integrated circuit.

In a preferred embodiment, the back end circuitry includes half bridge switching arrangement 114 that drives the HID lamp 150 through a series inductor LRES and where a parallel capacitor CRES is also provided across the lamp. The lamp current is returned to the midpoint of two capacitors (C1, C2) connected in series form the DC bus capacitor to the common return COM. As is the case with the embodiments of FIGS. 1 and 2, the ballast circuit 100 of FIG. 4 along with control circuit 120 are preferably used in HID ballast designs where lamp power is relatively low and cost and physical size are key considerations. The ballast system 100 is also intended for use to operate with 120 VAC, 220VAC and 277VAC line voltages and preferably not for use in systems that include hot re-strike capabilities.

Figure 5:
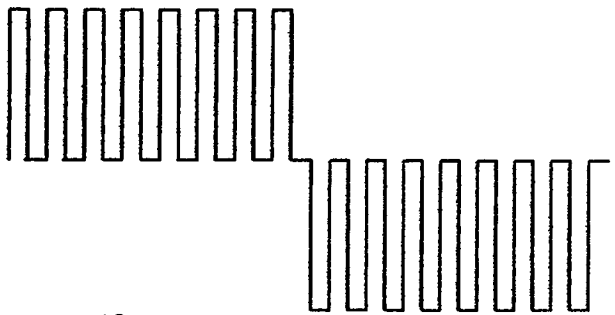
FIG. 5 illustrates a high frequency and low frequency signal utilized by the ballast circuit of FIG. 4.

Power factor correction is preferably provided in much the same manner as in the IRS2168D and discussed above. Similarly zero crossing detection may be provided in a manner similar to that provided in the IRS2168D. Alternatively, the ZX pin may sense the point at which stored energy has been transferred from the boost inductor L1 to the load (the zero crossing) by sensing the drain voltage of the boost MOSFET MB1 in a manner similar to that described above with respect to flyback MOSFET M1 of FIGS. 1 and 2. The half bridge drive portion 114 preferably provides a combined low frequency and high frequency signal illustrated in FIG. 5. The high frequency component will be filtered out leaving a low frequency, approximately square wave voltage across the lamp 150 and current through the lamp. Adjusting the duty cycle of the high frequency component allows the lamp voltage to be controlled and with it the lamp power. The lamp is connected to the mid point of two series capacitors C1, C2 which serve as bus capacitors.

Figure 6:
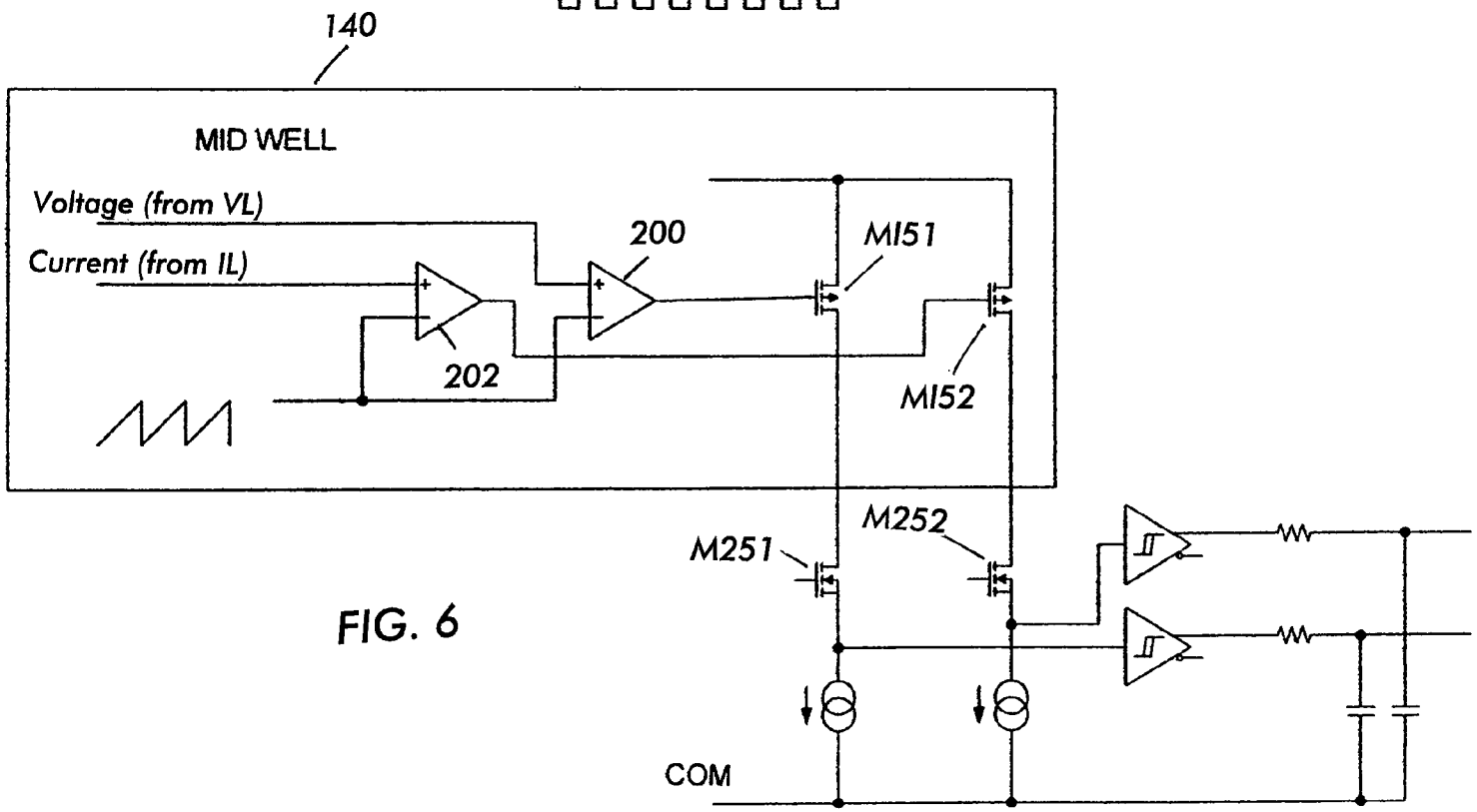
FIG. 6 illustrates a mid-well of a control circuit used in the ballast circuit of FIG. 5.

Lamp ignition is provided by generating a high frequency square wave voltage at the half bridge 114 and sweeping the frequency from a point above resonance to a point close to resonance to build the required high voltage at the lamp 150 in a manner similar to that described above with respect to FIGS. 1 and 2. The voltage required to light a metal halide lamp, for example, is about 3-4 kV. As is mentioned above with regard to FIGS. 1 and 2, this method eliminates the need for a separate ignition circuit. The output inductor LRES and capacitor CRES values required to filter out the high frequency component at the lamp output will determine the resonant frequency needed for ignition. The system operation changes after ignition (S74 in FIG. 7) at the start of the warm up phase (S76 of FIG. 7) to the combined high and low frequency signal of FIG. 5. In this manner, power supplied at the lamp 150 is maintained at the correct level during warm up and after ignition without forcing the DC bus voltage to go too low. The resulting voltage and current wave forms at the lamp will be approximately square waves at low frequency since the high frequency component is filtered out by the L and C filter. The voltage appearing at the lamp 150 and current flowing through the lamp is preferably measured at the lamp and fed back to the control circuit 120 which contains a multiplier that will determine true lamp power. This provides for excellent power management to ensure that power to the lamp remains substantially constant Since the lamp return is set at ½ VCC and not the common return COM some additional circuitry is preferred. In particular, a mid-well section 140 is provided in the control circuit 120 which is referenced to ½ VCC to which the lamp voltage (via pin VL) and lamp current (via pin IC) are provided. Theses feedback signals are preferably level shifted down to the low side of the IC using two internal high voltage level shift MISFITS (M1*s*1, M1*s*2, M2*s*1, M2*s*2) as illustrated in FIG. 6. The signals are preferably converted to a PWM signal within the mid-well 140 by comparing then to a ramp waveform via comparators 200, 202 such that the duty cycle varies proportional to the magnitude of the voltage and current levels. These signals are converter back to DC at the low side and fed into a multiplier which provides power regulation in steady state power regulation mode. FIG. 6 illustrates this feature. The control circuit 120 also preferably includes a floating high side 116 for driving the high side switch MHS of the half bridge 114 via output terminal HO as is common in fluorescent ballasts and in the control circuit 12 (12$^1$) of FIGS. 1 and 2.

Figure 7:
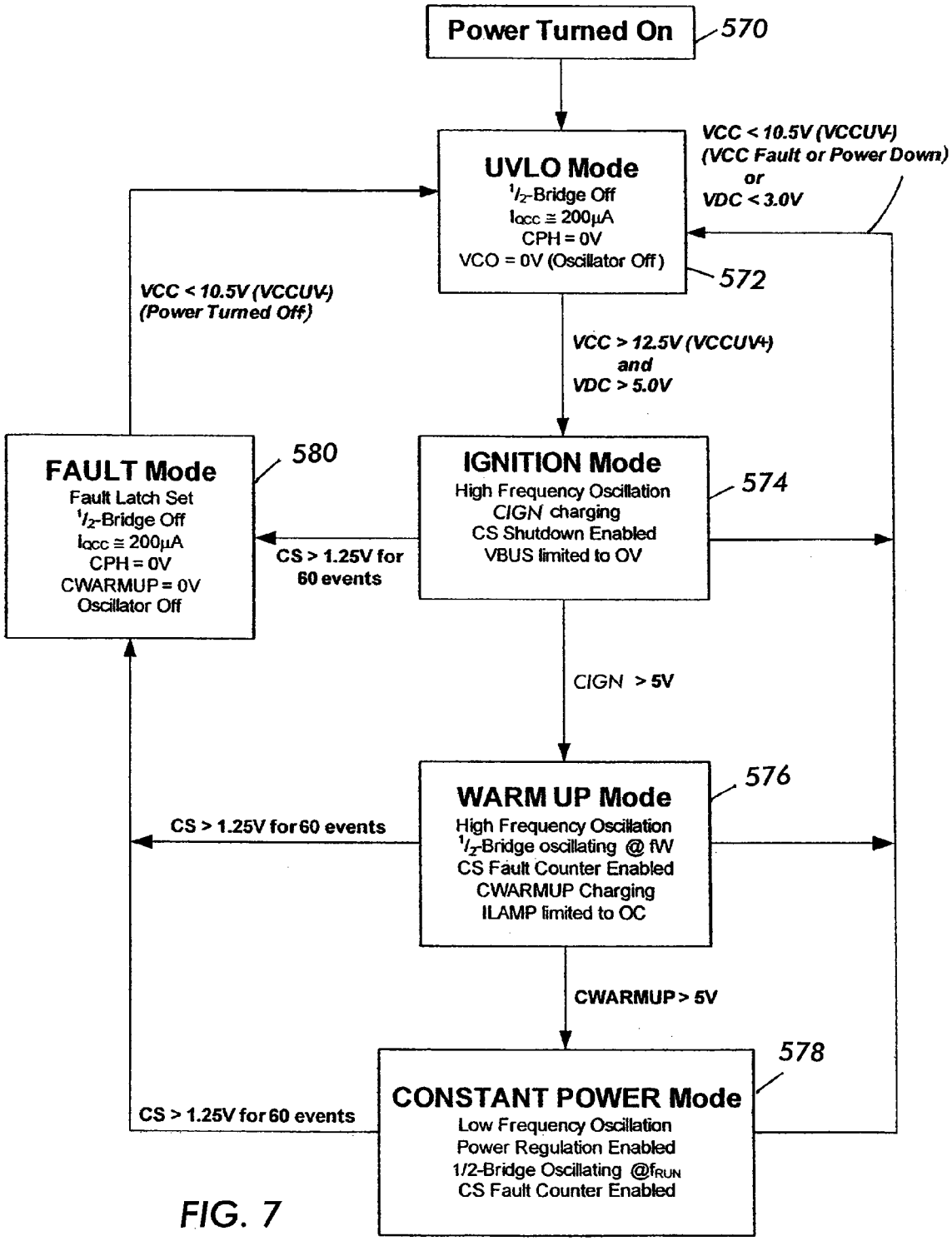
FIG. 7 is a state diagram illustrating the various modes in which the ballast circuit of FIG. 5 operates.

FIG. 7 is a state diagram illustrating the progression of the ballast through the various available phases of operation of the lamp 150 through ignition and warm up phases and finally to the constant power running phase. In addition, the ballast circuit 100 also includes over voltage limiting which prevents the DC bus voltage from going above a programmed limit prior to ignition. Over current limiting is also provided during warm up and during the constant power phase as well to prevent lamp current from exceeding a predetermine limit. This also provides protection against a short circuit at the output. Timers are preferably provided in the control circuit 120 such that over voltage and over current conditions persist for more than a predetermined period of time, the control circuit 120 will shut down to prevent damage to the system 100. The control circuit 120 preferably does not attempt restart under any condition.

As can be seen in FIG. 7, after the power is turned ON at S70, under voltage lock out mode (UVLO) mode S72 begins. The half bridge 114 is OFF as well as the oscillator. When the supply voltage at pin VCC exceeds the positive under voltage limit VCCUV+ (12.5 volts in FIG. 7) and when the enable signal VDC reaches 5V, ignition mode S74 is entered. High frequency oscillation of the half bridge 14 begins and the capacitor CIGN starts charging. Current sensing also begins using feedback information provided via pin CS. If the voltage at this pin rises above 1.25 volts for more than a predetermined period of time (60 seconds in FIG. 7) fault mode S77 is entered and the half bridge 114 is turned OFF along with the oscillator. When the IGN pin voltage exceeds a set amount (5 volts in FIG. 7) warm up mode S76 begins. At this point, the bridge 114 begins to provide the combination high frequency/low frequency signal of FIG. 5 as the capacitor CWARMUP charges and the current lamp is limited as mentioned above. Once the voltage on the capacitor CWARMUP reaches a predetermined value at pin WARMUP (5V in FIG. 3) constant power, or run mode S78 is entered. The combination high frequency/low frequency signal continues in this mode. Current sensing also continues. The ballast circuit 100 stays in this mode unless a fault occurs, i.e.: the voltage at pin CS exceeds 1.25 volts for a predetermined time or the supply voltage VCC drops down below a lower undervoltage threshold voltage VCCUV− (10.5 volts in FIG. 3) or the enable signal VDC goes low (less than 3V) for a required time.

Figure 8:
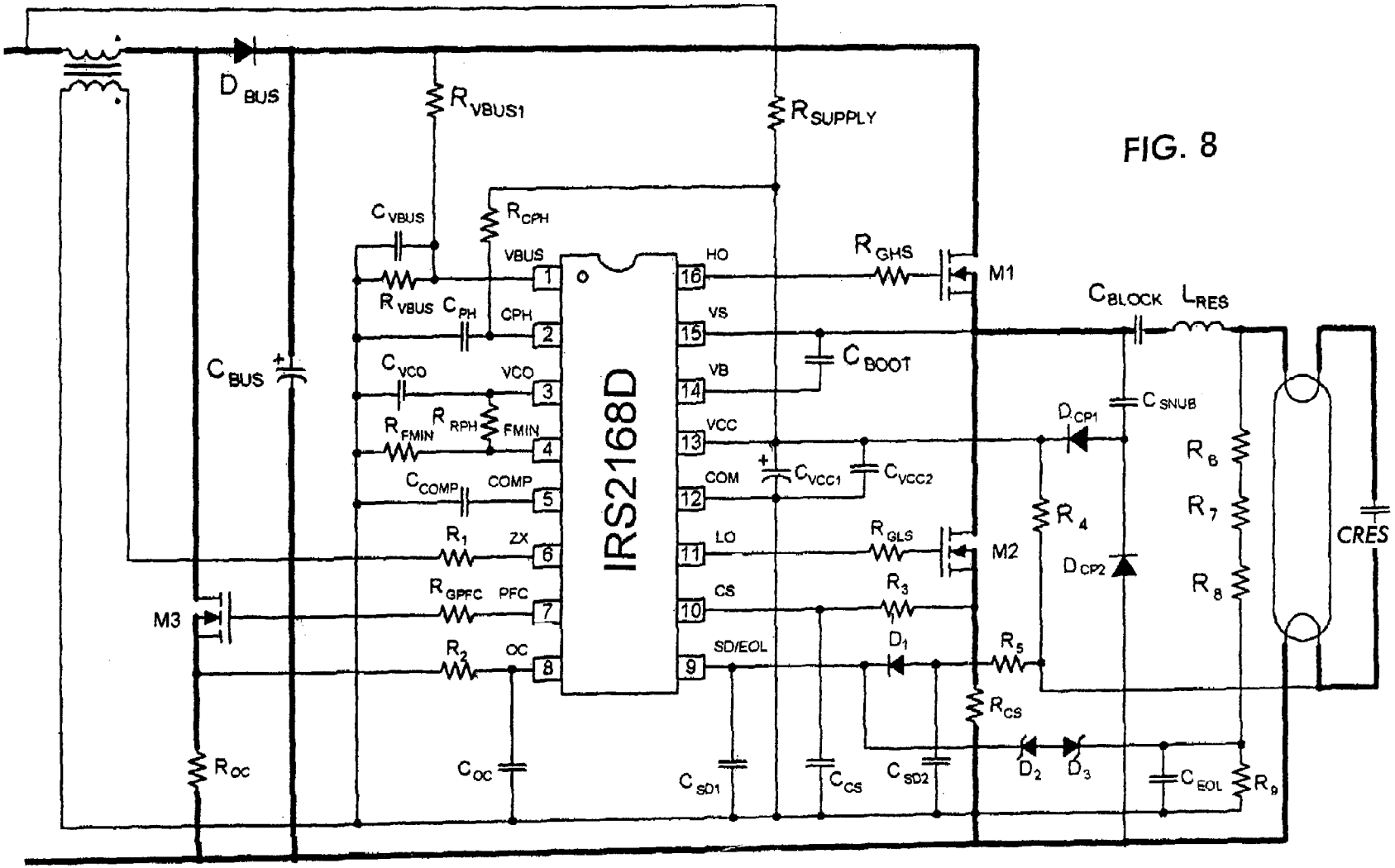
FIG. 8 is an example of an application circuit in which assignees International Rectifier Corporation's ballast control integrated circuit IRS2168D may be used.
Figure 9:
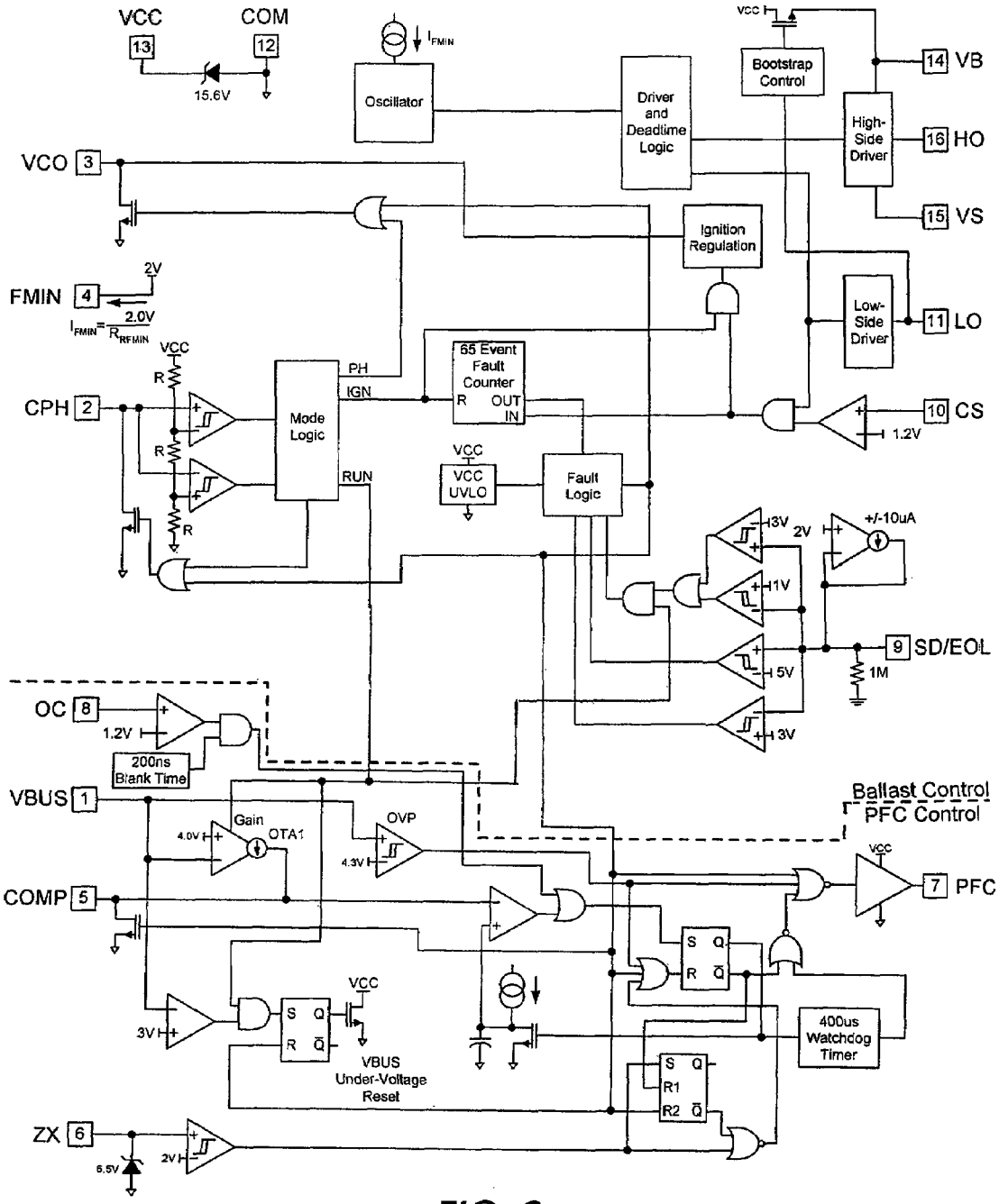
FIG. 9 is a block diagram of International Rectifier Corporation's ballast control integrated circuit IRS2168D.
Figure 10:
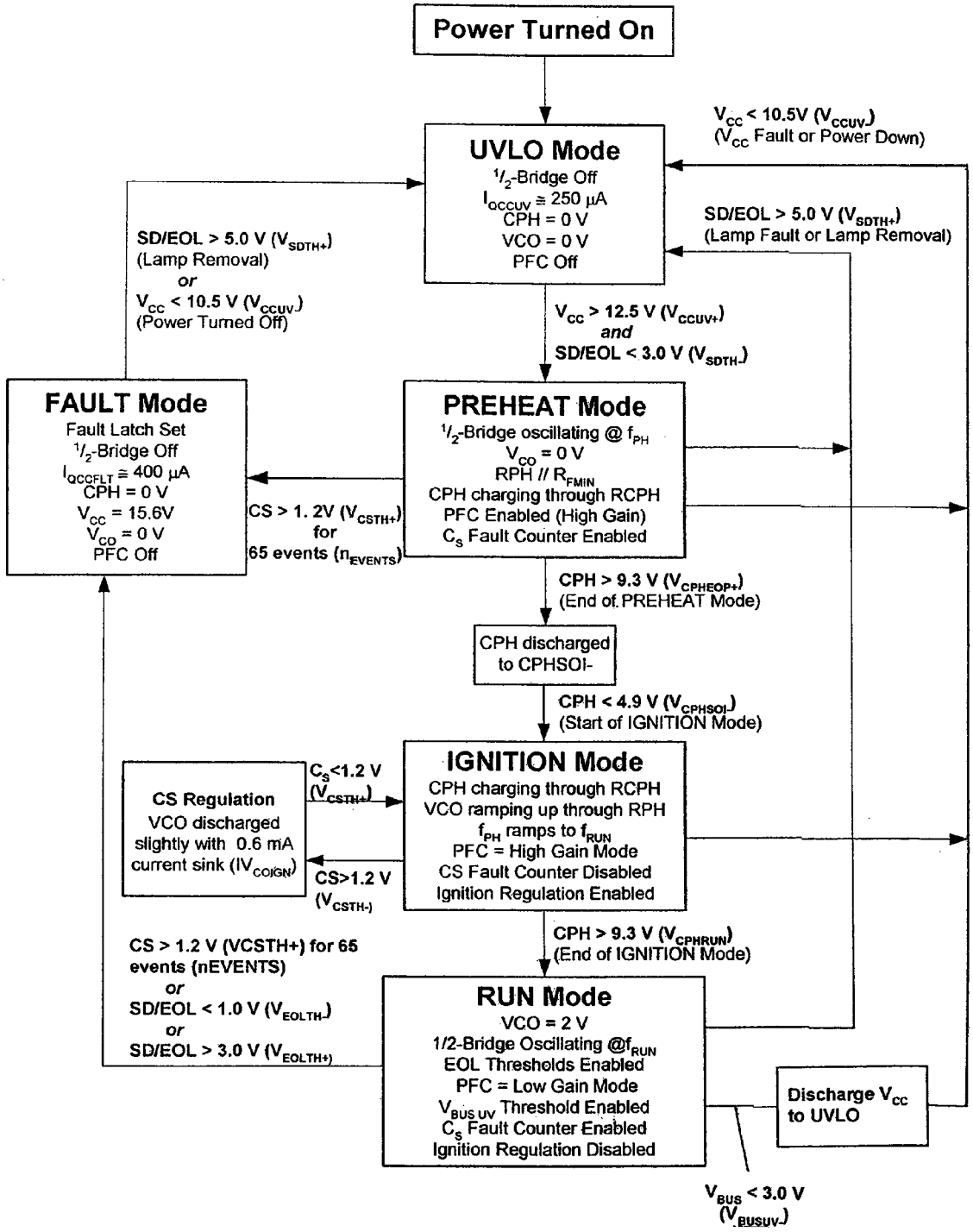
FIG. 10 is a state diagram illustrating the various modes in which the application circuit of FIG. 8 is controlled by the control integrated circuit of FIG. 9.

FIG. 8 is an illustration of an exemplary application circuit suitable for use with assignee International Rectifier Corporation's ballast control integrated circuit IRS2168D. FIG. 9 is a block diagram of the IRS2168D mentioned above. FIG. 10 is a illustration of a state diagram illustrating the way in which the IRS2168D controls the application circuit and the lamp of FIG. 8. As is noted above, the control circuit(s) 12, 120 of the present application operate in a substantially similar manner as the IRS2168D.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ballast circuit operable to drive a high intensity discharge lamp comprises:

an energy conversion circuit operable to convert an input voltage into a bus voltage and to provide the bus voltage to a DC bus;

a first half bridge connected across the DC bus and operable to control an output voltage supplied to the lamp;

a control circuit operable to control the first half bridge such that a desired output voltage is provided to the lamp, the control circuit having a low voltage gate drive system to provide power factor correction;

a series inductor connected in series between the first half bridge and the lamp; and a parallel capacitor connected across the lamp, wherein the control circuit operates the first half bridge at a high frequency for a set period of time such that a high voltage is built up across the parallel capacitor, and then reduces the frequency of the first half bridge until it approaches a resonance frequency which ignites the lamp.

2. The ballast circuit of claim 1, wherein the resonance frequency is based on an inductance value of the series inductor and a capacitance value of the parallel capacitor.

3. The ballast circuit of claim 2, wherein the energy conversion device is a flyback transformer, and wherein the control circuit provides zero crossing detection such that a time when all of the energy in the flyback transformer is transferred to the lamp is detected based on a drain voltage of a flyback MOSFET connected between the primary coil of the transformer and a common return of the ballast circuit.

4. The ballast circuit of claim 3, wherein the control circuit controls the flyback MOSFET to provide power factor correction.

5. The ballast circuit of claim 2, wherein the energy conversion device is a flyback transformer, and wherein the control circuit provides zero crossing detection such that a time when all of the energy in the flyback transformer is transferred to the lamp is detected based on a voltage at a node positioned between a secondary coil of the flyback transformer and a diode positioned between the flyback transformer and the DC bus.

6. The ballast circuit of claim 4, further comprising a first current sense resistor positioned at a source of the flyback MOSFET and connected to the control circuit to provide an indication of current through the flyback switch, such that the control circuit detects faults in the primary coil and the flyback switch based on the current through the flyback switch.

7. The ballast circuit of claim 6, further comprising a second current sense resistor operable to sense the lamp current through the lamp and to provide a signal indicative of the lamp current to the control circuit.

8. The ballast circuit of claim 7, wherein the control circuit determines the power provided by to the lamp based on the signal indicative of the lamp current and the DC bus voltage to provide a signal indicating the power provided to the lamp, and wherein the control circuit controls the first half bridge to maintain a substantially constant lamp power.

9. The ballast circuit of claim 8, wherein the control circuit reduces the frequency of the first half bridge a predetermined period of time after the lamp ignites until a desired low frequency operating frequency is reached.

10. The ballast circuit of claim 9, wherein the control circuit turns the first half bridge off when the current through the flyback switch exceeds a second predetermined value for a second predetermined period of time.

11. The ballast circuit of claim 9, wherein the control circuit turns the first half bridge off when a supply voltage drops below a set under voltage value.

12. The ballast circuit of claim 9, wherein the control circuit turns the first half bridge off when an enable signal drops below a set enablement value.

13. The ballast circuit of claim 9, further comprising a second half bridge, connected to an opposite side of the lamp such that the first half bridge and the second half bridge form a full bridge to drive the lamp.

14. A ballast circuit operable to drive a high intensity discharge lamp comprises:

a first half bridge connected across a DC bus having a bus voltage and operable to control an output voltage supplied to the lamp;

a control circuit operable to control the first half bridge such that a desired output voltage is provided to the lamp, the control circuit having a low voltage gate drive system to provide power factor correction;

a series inductor connected between the first half bridge and the lamp;

a parallel capacitor connected across the lamp, wherein the control circuit operates the first half bridge at a high frequency such that a high voltage is built up across the parallel capacitor, and then reduces the frequency of the first half bridge to approach a resonance frequency to ignite the lamp.

15. The ballast circuit of claim 14, wherein the resonance frequency is based on an inductance value of the series inductor and a capacitance value of the parallel capacitor.

16. The ballast circuit of claim 14, wherein the control circuit turns the first half bridge off when a lamp current exceeds a predetermined value for a predetermined period of time.

17. The ballast circuit of claim 14, wherein the control circuit reduces the frequency of the first half bridge a predetermined period of time after the lamp ignites until a desired frequency is reached.

18. The ballast circuit of claim 14, wherein the control circuit turns the first half bridge off when a supply voltage drops below a set under voltage value.

19. The ballast circuit of claim 14, wherein the control circuit turns the first half bridge off when an enable signal drops below a set enablement value.

20. The ballast circuit of claim 14, further comprising a second half bridge, connected to an opposite side of the lamp such that the first half bridge and the second half bridge form a full bridge to drive the lamp.

* * * * *